US008069671B2

(12) United States Patent
Hellat et al.

(10) Patent No.: US 8,069,671 B2
(45) Date of Patent: Dec. 6, 2011

(54) BURNER FUEL LANCE CONFIGURATION AND METHOD OF USE

(75) Inventors: Jaan Hellat, Rütihof (CH); Adnan Eroglu, Untersiggenthal (CH); Jan Cerny, Fahrwangen (CH); Douglas Anthony Pennell, Windisch (CH)

(73) Assignee: ALSTOM Technology Ltd., Baden (CH)

( * ) Notice: Subject to any disclaimer, the term of this patent is extended or adjusted under 35 U.S.C. 154(b) by 163 days.

(21) Appl. No.: 12/694,506

(22) Filed: Jan. 27, 2010

(65) Prior Publication Data

US 2010/0146983 A1 Jun. 17, 2010

Related U.S. Application Data

(63) Continuation of application No. PCT/EP2008/059321, filed on Jul. 16, 2008.

(30) Foreign Application Priority Data

Aug. 7, 2007 (DE) ..... 10 2007 037 289

(51) Int. Cl.
*F02C 7/22* (2006.01)
*F02C 1/00* (2006.01)

(52) U.S. Cl. ..... 60/776; 60/737; 60/740

(58) Field of Classification Search ..... 60/742, 60/776, 737, 738, 740, 748, 739; 431/350, 431/351, 352, 354, 173
See application file for complete search history.

(56) References Cited

U.S. PATENT DOCUMENTS

| | | | | |
|---|---|---|---|---|
| 4,850,194 | A * | 7/1989 | Fuglistaller et al. | 60/737 |
| 5,216,885 | A * | 6/1993 | Taniguchi et al. | 60/737 |
| 5,408,825 | A * | 4/1995 | Foss et al. | 60/39.463 |
| 5,735,126 | A * | 4/1998 | Schulte-Werning | 60/732 |
| 5,735,466 | A * | 4/1998 | Kramer et al. | 239/406 |
| 5,829,967 | A * | 11/1998 | Chyou | 431/350 |
| 5,833,451 | A * | 11/1998 | McMillan | 431/350 |
| 5,895,211 | A * | 4/1999 | McMillan | 431/10 |
| 5,943,866 | A * | 8/1999 | Lovett et al. | 60/737 |
| 6,158,223 | A * | 12/2000 | Mandai et al. | 60/737 |
| 6,918,256 | B2 * | 7/2005 | Gutmark et al. | 60/737 |
| 2004/0045296 | A1 * | 3/2004 | Wiebe et al. | 60/737 |
| 2005/0268617 | A1 * | 12/2005 | Amond et al. | 60/776 |
| 2006/0154192 | A1 * | 7/2006 | Flohr et al. | 431/353 |
| 2008/0295519 | A1 * | 12/2008 | Park | 60/740 |

FOREIGN PATENT DOCUMENTS

| | | |
|---|---|---|
| DE | 10334228 | 3/2004 |
| DE | 10345137 | 4/2005 |
| DE | 102005015152 | 10/2006 |
| EP | 0321809 | 6/1989 |
| EP | 0704657 | 4/1996 |
| EP | 1526333 | 4/2005 |
| WO | WO2006/042796 | 4/2006 |

* cited by examiner

*Primary Examiner* — Ehud Gartenberg
*Assistant Examiner* — Gerald Sung
(74) *Attorney, Agent, or Firm* — Cermak Nakajima LLP; Adam J. Cermak

(57) ABSTRACT

A burner (1) for a combustion chamber of a turbogroup includes a swirl generator (2), a mixer (3), and a lance (4) for introducing pilot fuel into a combustion space (10). In order to stabilize combustion, the lance (4) is designed and/or arranged so that, at least in the pilot mode of the burner (1), it extends far enough into the burner interior (5) for a flame front (16) of a combustion reaction, which takes place in the combustion space (10), to extend at least partially into the burner interior (5).

11 Claims, 5 Drawing Sheets

BURNER FUEL LANCE CONFIGURATION AND METHOD OF USE

This application is a Continuation of, and claims priority under 35 U.S.C. §120 to, International application no. PCT/EP2008/059321, filed 16 Jul. 2008, and claims priority therethrough under 35 U.S.C. §119, 365 to German application no. 10 2007 037 289.4, filed 7 Aug. 2007, the entireties of which are incorporated by reference herein.

BACKGROUND

1. Field of Endeavor

The present invention refers to a burner for a combustion chamber of a turbogroup, especially in a power plant.

2. Brief Description of the Related Art

Such burners have a swirl generator which encloses a burner interior on the inlet side and has at least one tangential air inlet with regard to a longitudinal center axis of the burner. In addition, such a burner includes a mixer which encloses the burner interior on the outlet side and has an outlet opening which is open to a combustion space of the combustion chamber. Furthermore, such a burner can be equipped with a lance for introducing pilot fuel into the combustion space. The lance in this case is arranged coaxially to the longitudinal center axis of the burner and extends from a burner head into the burner interior.

A problem which exists in the case of such burners is the risk of a flame flashback from the combustion chamber into the burner interior. Such flame backflashes are to be attributed to instabilities in the combustion process.

SUMMARY

One of numerous aspects of the present invention deals with an improved embodiment for a burner of the aforementioned type, which is characterized in particular by increased stability of the combustion process in the combustion space.

Another aspects is based on the general idea of designing the lance significantly longer so that it can project deeper into the burner interior in the direction of the outlet opening. In this case, the knowledge is used that a velocity profile is formed in the mixer for the mixture flow and in the center has significantly higher velocities than in the boundary region. By lengthening the lance in the direction of the outlet opening, the velocity in the center can be reduced, while at the same time the flow velocity in the boundary regions increases. The increased flow velocity in the boundary region, however, effectively counteracts a flame backflash. As a result of the directed positioning of the lance, which is displaced in the direction of the outlet opening, the effect can also be achieved of a flame front, which results during operation of the combustion chamber as a result of the combustion reaction, projecting at least partially into the burner interior. This is to be attributed to the reduced flow velocity in the center of the velocity profile in the mixer. As a result of the directed positioning or lengthening of the lance, therefore, the stationary flame front can extend partially inside the burner interior. This is advantageous in several respects. For one thing, the directed introduction of fuel into the flame front by the lance can be improved since the distance between the free-standing lance end and the flame front is reduced. For another thing, the interaction between a plurality of burners of the combustion chamber via the combustion space is reduced since the part of the flame front which projects into the respective burner interior with regard to the respective burner is comparatively independent of the other burners and therefore stable. The proposed type of construction, therefore, especially enables results from test stand installations, which operate with only one burner, to be transferred to industrial installations in which the combustion chamber has a plurality of burners.

In an advantageous embodiment, provision can be made for the lance to have a plurality of concentrically arranged pipes, for example a central inner pipe which includes a central passage for liquid fuel and has at least one axial outlet opening at the lance end. A hollow-walled outer pipe which encloses the inner pipe, forming an inner annular passage, can also be provided and in its hollow wall includes at least one outer passage for gaseous fuel. In this case, the inner annular passage terminates axially open at the lance end and serves for the guiding of air. As a result of the construction with concentric pipes, liquid fuel on the one hand and gaseous fuel on the other hand can be fed alternately or simultaneously via the lance. At the same time, the guiding of air through the annular passage enables cooling of the lance. Furthermore, the guiding of air through the inner annular passage makes purging of the central passage or of the at least one outer passage superfluous, if only gaseous or only liquid fuel is fed via the lance. Furthermore, with the air which is fed via the inner annular passage in the burner interior, a media separation between liquid fuel and gaseous fuel, at least up to the flame front, can be achieved. This can be advantageous for realizing a stable combustion reaction.

Further important features and advantages of the burner according to the invention result from the drawings, and from the associated figure description with reference to the drawings.

BRIEF DESCRIPTION OF THE DRAWINGS

Preferred exemplary embodiments of the invention are shown in the drawings and are explained in more detail in the following description, wherein like designations refer to the same or similar, or functionally the same components. In the drawing, schematically in each case.

DETAILED DESCRIPTION OF EXEMPLARY EMBODIMENTS

Figure 1:
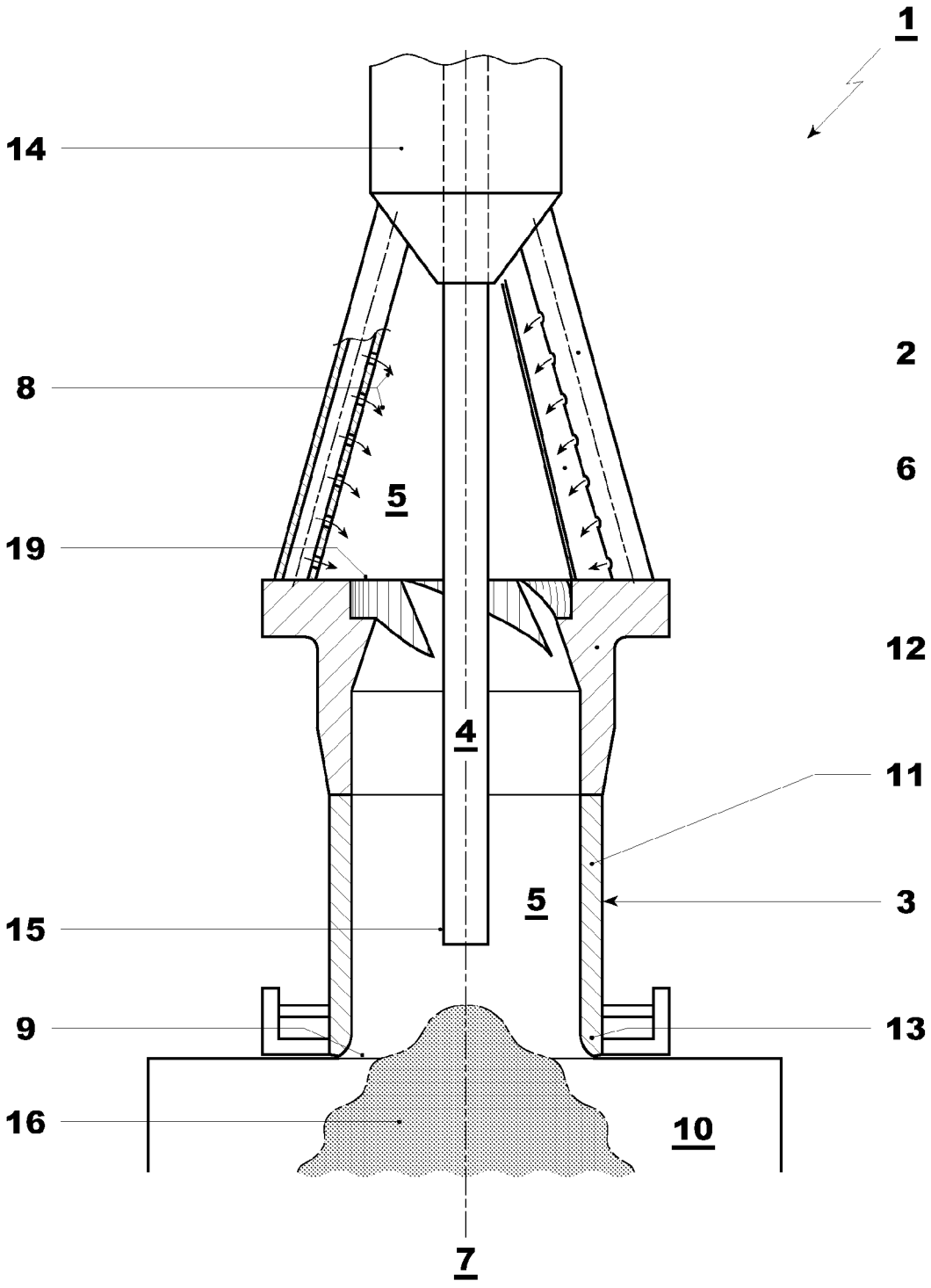
FIG. 1 shows a much simplified longitudinal section through a burner.

According to FIGS. 1 to 5, a burner 1 includes a swirl generator 2, a mixer 3, and a lance 4. The burner 1 in the installed state forms a component part of a combustion chamber, which is not otherwise shown here, of a turbogroup which is especially arranged in a power plant.

The swirl generator 2 encloses an inlet-side section of a burner interior 5 and has at least one air inlet 6 which extends tangentially with regard to a longitudinal center axis 7 of the burner 1. In the case of the examples which are shown, the swirl generator 2 is conically designed. The respective air inlet 6 in this case forms a longitudinal slot along the generated surface of the cone. A plurality of such air inlets 6 are preferably arranged in a distributed manner in the circumferential direction. As a result of this, the air can penetrate tangentially into the burner interior 5, as a result of which a swirl is imparted to it. In the case of the examples which are shown, the swirl generator 2 also has a fuel inlet 8 via which gaseous fuel can be introduced into the burner interior 5. For example, this fuel inlet 8 includes a plurality of rows of individual inlet orifices which extend along the surface line of the conical swirl generator 2, through which orifices the fuel gas can enter the burner interior 5. In this case, the fuel inlet 8 can also be tangentially oriented in order to intensify the swirl effect. By the same token, the fuel inlet 8 can create a certain radial component in order to improve the mixing-through with the air.

The mixer 3 encloses an outlet-side section of the burner interior 5 and has an outlet opening 9 which is open towards a combustion space 10 of the combustion chamber. The mixer 3, for example, includes a tubular body 11 which is connected via a tubular transition piece 12 to the swirl generator 2 and carries an outlet flange 13 with the outlet opening 9. Via the outlet flange 13, the burner 1 can be connected to the combustion chamber. The mixer 3 is expediently cylindrically formed.

The lance 4 serves for introducing pilot fuel into the combustion space 10. For this purpose, the lance 4 is arranged coaxially to the longitudinal center axis 7. In addition, the lance 4, at least in pilot mode of the burner 1, extends from a burner head 14, which essentially forms the tip of the conical swirl generator 2, into the burner interior 5. The lance 4 therefore starts from the burner head 14 and terminates with a lance end 15 in a free-standing manner in the burner interior 5.

In the case of the embodiment which is shown in FIG. 1, a part of a flame front 16 is also shown, which during operation of the combustion chamber is formed as a result of the combustion reaction which takes place in the combustion space 10. A part of this flame front 16 visibly projects into the burner interior 5, specifically into an end section of the burner interior 5 which is enclosed by an outlet-side end region of the mixer 3. In the example which is shown, the flame front 16 remains inside the section of the burner interior 5 which is encompassed by the outlet flange 13. Such a characteristic of the flame front 16, in which a part of the flame front 16 projects through the outlet opening 9 into the burner interior 5, is achieved by a special design and/or arrangement of the lance 4. In pilot mode of the burner 1, the lance 4 extends with its free-standing end 15 comparatively far into the burner interior 5, that is to say far enough for a part of the flame front 16 to extend into the burner interior 5. So that the lance 4 can project thus deep into the burner interior 5 in the direction of the outlet opening 9, the lance 4 has to be correspondingly designed so that it has the axial length which is necessary for this. In the case of the embodiments which are shown in FIGS. 1, 2, 4, and 5, the lance 4 is positioned in the burner 1 so that its free-standing end 15 is located in a section of the burner interior 5 which is enclosed by the mixer 3. In other words, the lance 4 extends right into the mixer 3. In this case, the lance 4 can extend with its free-standing end 15 in the axial direction up to about half-way through the mixer 3 or even further into the mixer 3. For example, a distance 17 which is drawn in FIG. 2, which the free-standing lance end 15 has from the outlet opening 9, is more than 25%, or less than 50%, of a distance 18 which an outlet-side end 19 of the swirl generator 2 has from the outlet opening 9. The distance 17 between outlet opening 9 and lance end 15 preferably lies within a range of 25% to 50% of the distance 18 between outlet opening 9 and outlet-side end 19.

Figure 2:
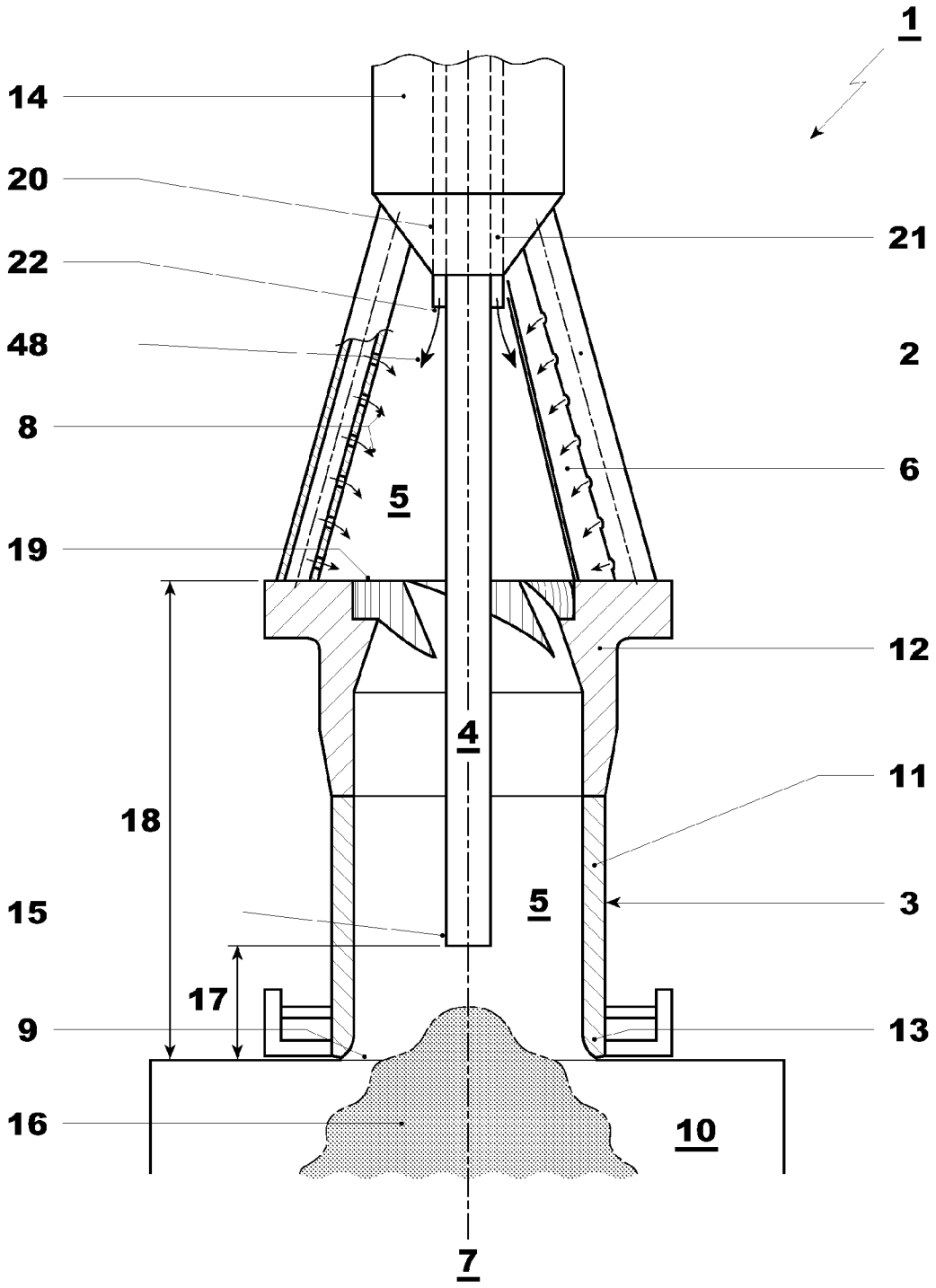
FIG. 2 shows a view as in FIG. 1, but in the case of another embodiment.

According to FIG. 2, an inlet pipe 20, which extends coaxially to the lance 4, can be arranged on the burner head 14. This inlet pipe 20 in this case projects in the axial direction into a section of the burner interior 5 which is enclosed by the swirl generator 2. This inlet pipe 20 can form an annular inlet passage 21 for liquid fuel. The inlet passage 21 has at least one axially oriented outlet opening 22. Through this at least one axial outlet opening 22 the liquid fuel can enter the burner interior 5 essentially in the axial direction, corresponding to arrows 48. The burner 1 can therefore be operated with fuel gas and/or with liquid fuel. A plurality of such axial outlet openings 22 are preferably arranged at the end of the inlet pipe 20 which terminates in the burner interior 5.

Figure 3:
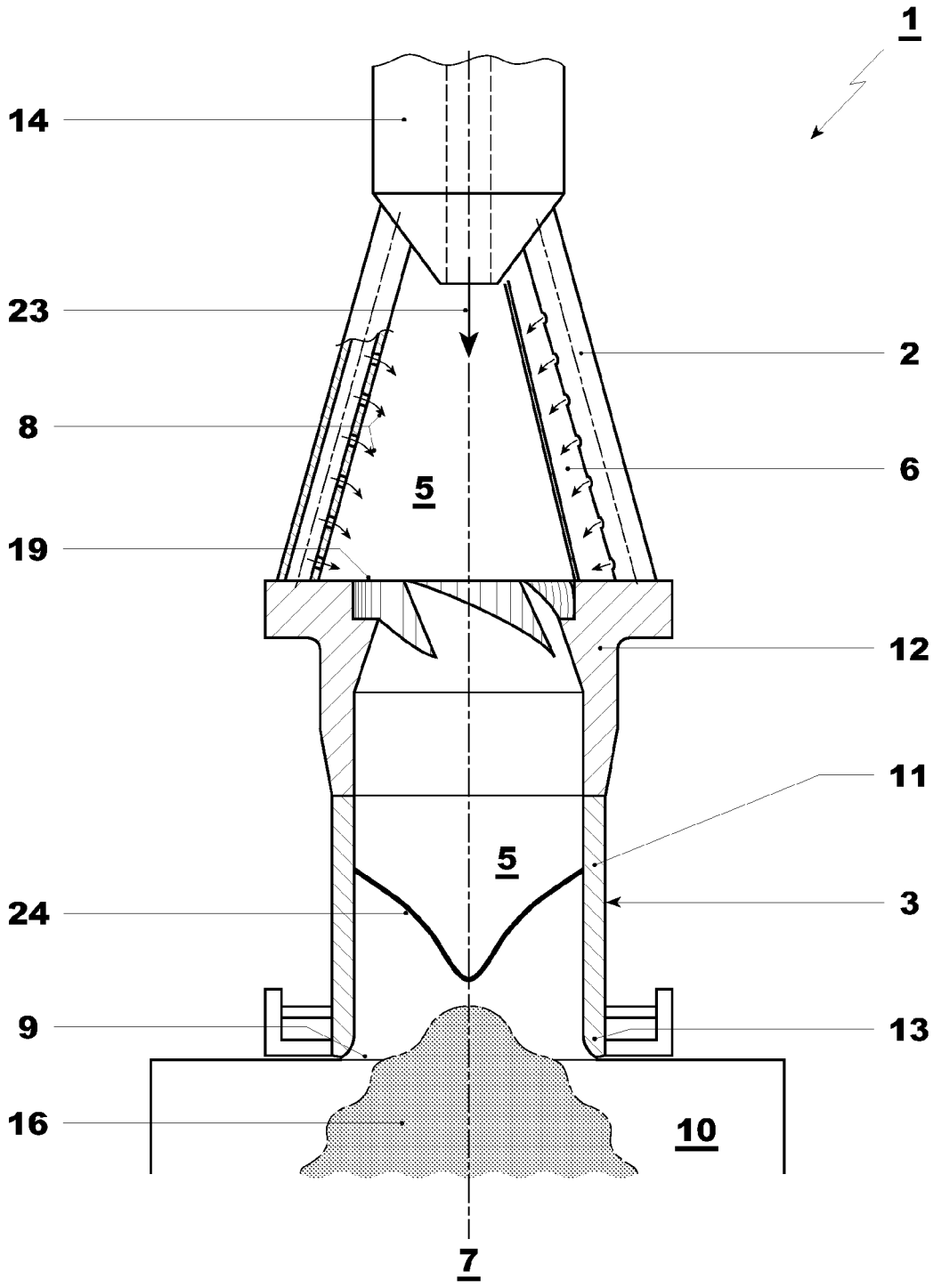
FIG. 3 shows a view as in FIGS. 1 and 2, but with the lance extended.

According to a preferred embodiment, the lance 4 can be arranged on the burner head 14 in an adjustable manner in the axial direction. Therefore, the axial position of the free-standing lance end 15 inside the burner interior 5 is adjustable. In particular, the position of the part of the flame front 16 which projects into the burner interior 5 can be adjusted as a result. By means of the longitudinally-adjustable lance 4, the burner 1 can be adapted to operating parameters of the combustion chamber, which enables stabilization of the combustion process. The lance 4, therefore, depending upon requirement, can be retracted by a greater or lesser depth into the burner interior 5, or extended by a greater or lesser distance from the burner interior 5. FIG. 3 shows a situation in which the lance 4 is largely extended from the burner interior 5. The lance end 15 then expediently terminates on the inner side of the burner head 14 which faces the burner interior 5. In FIG. 3, for ease of view, the lance 4 is fully extended. It can be retracted again into the burner interior 5, corresponding to an arrow 23. In the case of the configuration which is shown in FIG. 3, the flame front 16 is arranged completely outside the burner interior 5 and is located downstream of the outlet opening 9 with regard to the flow direction of the burner 1.

In FIG. 3, a velocity profile 24 is shown in a simplified view and represents the distribution of the flow velocity along the cross section of the burner 1 inside the mixer 3. The flow, when the lance 4 is absent, visibly has a significant maximum in the center. By retracting the lance 4 into the described region inside the mixer 3, the flow velocity in the center of the cross section of the mixer 3 is inevitably reduced. At the same time, outside the lance 4, that is to say in the boundary region of the cross section, the velocity is correspondingly increased as a result in order to ensure a constant volumetric flow. The reduction of the central flow velocity enables the flame front 16 to migrate upstream. With corresponding positioning and design of the lance 4, the flame front 16 partially projects into the burner interior 5, as is shown in FIG. 1.

Figure 4:
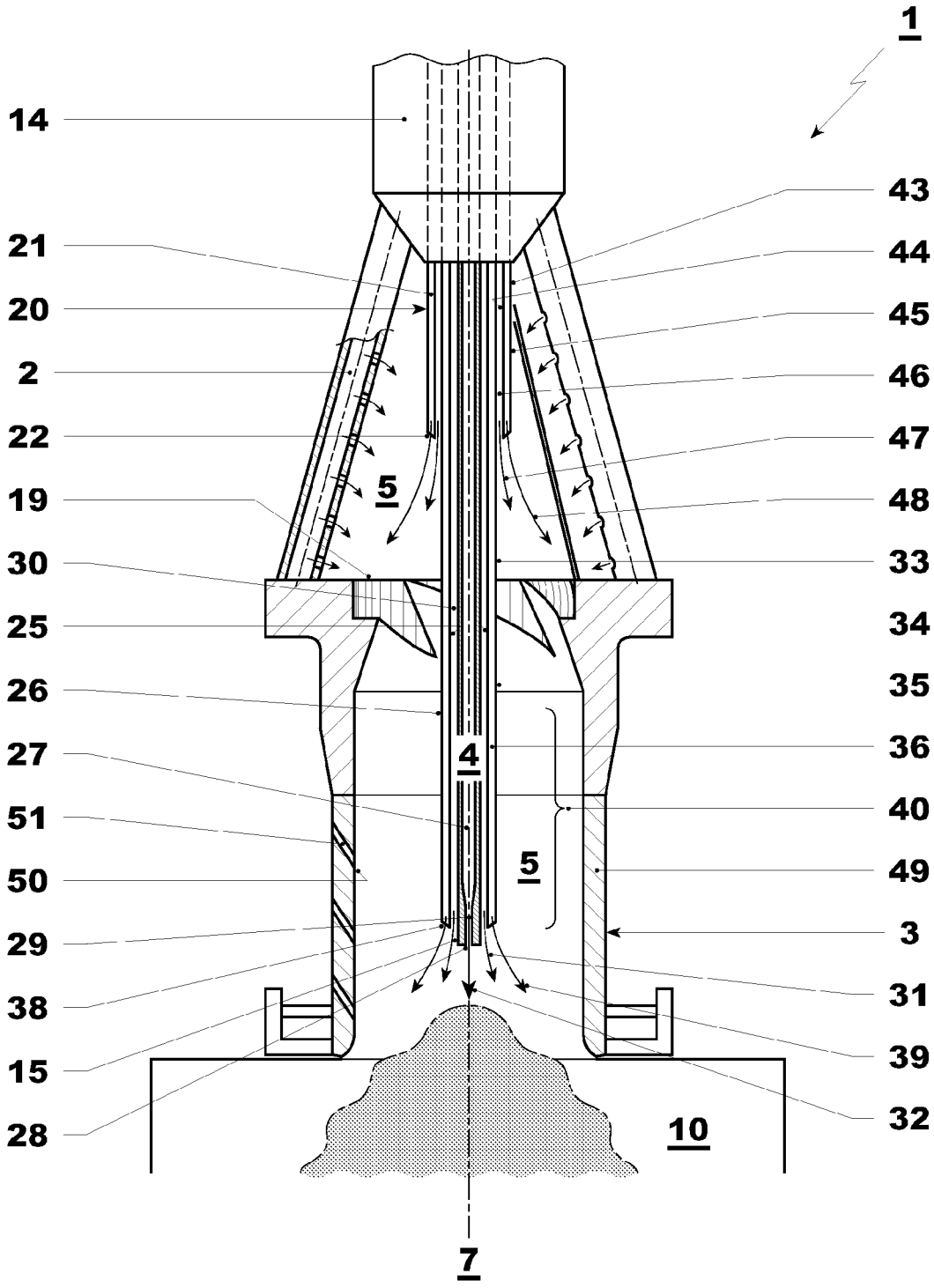
FIG. 4 shows a view as in FIGS. 1 and 2, but with a detailed view of the lance.
Figure 5:
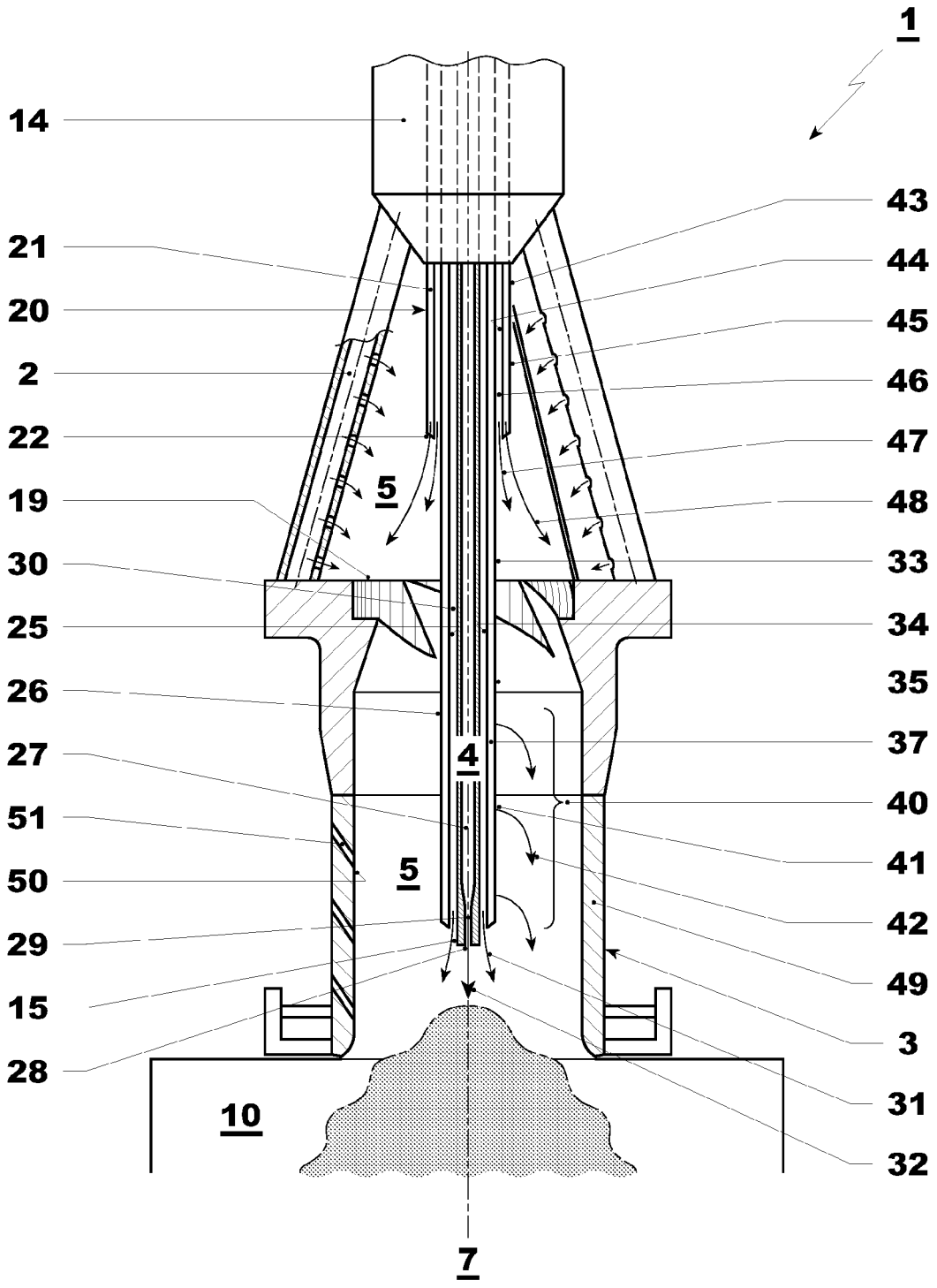
FIG. 5 shows a view as in FIG. 4, but in the case of another embodiment of the lance.

In FIGS. 4 and 5, the lance 4 is also shown in section. The following detailed description of the lance 4 in this case especially also applies to the embodiments of FIGS. 1 to 3.

According to FIGS. 4 and 5, the lance 4 has a plurality of pipes which are arranged concentrically to each other, specifically a central inner pipe 25 and an outer pipe 26. The inner pipe 25 includes a central passage 27 and has axially oriented outlet openings 28 which are arranged at least at the free-standing lance end 15. The central passage 27 serves for feeding liquid fuel to the at least one outlet opening 28. In the example, the inner pipe 25 is equipped with a nozzle-like cross-sectional narrowing 29 in the region of the outlet opening 28, which enables the formation of an intensive liquid jet. This liquid fuel jet is indicated in FIGS. 4 and 5 by an arrow 32. The outer pipe 26 is dimensioned so that it encloses the inner pipe 25, forming an inner annular passage 30. This inner annular passage 30 is axially open at the lance end 15 and therefore leads into the burner interior 5. The inner annular passage 30 serves for the guiding of air which can issue from the inner annular passage 30 in the axial direction, according to the arrow 31.

The outer pipe 26 is of a hollow-walled design, that is to say the outer pipe 26 has a hollow wall 33 with an inner wall 34 and an outer wall 35 which is radially spaced away from it. In the hollow wall 33, the outer pipe 26 includes at least one outer passage 36 (FIG. 4) or 37 (FIG. 5). This at least one outer passage 36, 37 serves for feeding gaseous fuel. The outer passage 36, 37 can be designed as an annular passage which is simply formed between the two walls 34, 35 of the wall 33. This outer annular passage 36 or 37, according to FIG. 4, can have at least one axially oriented outlet opening 38 at the lance end 15, as a result of which an essentially axially oriented injection of fuel gas, corresponding to an arrow 39, can be achieved. An arrangement of a plurality of radial outlet openings 41 can be additionally or alternatively provided in a lance end section 40, which is identified in FIG. 5 by a brace, and has the free-standing lance end 15. These radial outlet openings 41 are preferably formed in the outer wall 35 of the hollow wall 33 of the outer pipe 26. As a result of this, an essentially radially oriented injection of fuel gas into the burner interior 5 can be realized. The gaseous fuel which is radially injected in this way is deflected in this case into the axial direction, corresponding to arrows 42, on account of the prevailing axial flow in the burner interior.

In order to be able to selectively realize the axial injection 39 and the radial injection 42 in an outer annular passage 36 or 37, a corresponding control facility can be provided, which for example operates with a sleeve-like control element which in a first position is located upstream of the radial outlet openings 41, while in a second position it blocks the at least one axial outlet opening 38. In this case, a plurality of axial outlet openings 38, which are arranged in a distributed manner in the circumferential direction, are preferably arranged at the axial end of the outer pipe 26.

Alternatively to this, at least one first outer passage 36, which leads to the at least one axial outlet opening 38 at the lance end 15, can be formed in the hollow wall 33. In addition to this, at least one second outer passage 37, which leads to at least one of the radial outlet openings 41 which are formed in the lance end section 40, can be formed in the hollow wall 33. FIG. 4 in this case shows, for example, a section through the first outer passages 36, while FIG. 5 shows a section through the second outer passages 37. The first and second outer passages 36, 37 can be connected on the inlet side to different supply devices or control devices which can be operated independently of each other. As a result of this, it is possible to selectively realize the introduction of the gaseous fuel only through the at least one axial outlet opening 38 or only through the at least one radial outlet opening 41, or both through the at least one axial outlet opening 38 and through the at least one radial outlet opening 41.

In the case of the embodiments which are shown in FIGS. 4 and 5, the inner pipe 25 projects axially beyond the outer pipe 26. As a result of this, a certain media separation can be achieved during operation of the lance 4 for injecting the liquid fuel and for injecting the fuel gas. This media separation can also be assisted by the injected air 31.

In the case of the embodiments which are shown here, the inlet pipe 20, which is arranged on the burner head 14, is also of a hollow-walled design so that it has a hollow wall 43 with an inner wall 44 and an outer wall 45. The hollow-walled inlet pipe 20 in this case is also dimensioned so that it encloses the lance 4 or the outer pipe 26, forming an axially open annular passage 46. Air can be injected into the burner interior through this annular passage 46, corresponding to an arrow 47. As a result of this, effective cooling of the lance in the region of the burner head 14 can be achieved. The inlet passage 21, which serves for introducing the liquid fuel, corresponding to arrows 48, in this case is formed in the hollow wall 43 and in particular can also be formed in an annular manner.

FIGS. 4 and 5 show a further feature. In the case of these embodiments, a wall 49 of the mixer 3 is equipped with film cooling 50. Such film cooling 50 is realized for example by means of a plurality of cooling holes 51 which penetrate the corresponding wall 49 and can be exposed to throughflow with cooling medium which is applied on the side of the wall 49 which faces the burner interior 5 and as a result generates film cooling which protects the wall 49. Air serves as cooling medium as a rule. The cooling holes 51, as shown here, can be set in the principle flow direction of the burner 1 in order to improve the formation of a cooling film.

LIST OF DESIGNATIONS

1 Burner
2 Swirl generator
3 Mixer
4 Lance
5 Burner interior
6 Air inlet
7 Longitudinal center axis
8 Fuel gas inlet
9 Outlet opening
10 Combustion space
11 Tubular body
12 Transition piece
13 Outlet flange
14 Burner head
15 Free-standing lance end
16 Flame front
17 Distance between 9 and 4
18 Distance between 9 and 19
19 Outlet-side end of 2
20 Inlet pipe
21 Inlet passage
22 Inlet opening
23 Retraction movement of 4
24 Velocity profile
25 Inner pipe
26 Outer pipe
27 Central passage
28 Outlet opening
29 Nozzle
30 Inner annular passage
31 Air flow
32 Liquid fuel flow
33 Hollow wall
34 Inner wall
35 Outer wall
36 (First) outer passage
37 (Second) outer passage
38 Axial outlet opening
39 Fuel gas flow
40 Lance end section
41 Radial outlet opening
42 Fuel gas flow
43 Hollow wall
44 Inner wall
45 Outer wall

46 Annular passage
47 Air flow
48 Liquid fuel flow
49 Wall of 3
50 Film cooling
51 Cooling hole While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A burner for a combustion chamber of a turbogroup, the burner comprising:
a burner head;
a swirl generator enclosing a burner interior on an inlet side and which has at least one tangential air inlet relative to a longitudinal center axis of the burner;
a mixer enclosing the burner interior on an outlet side and which has an outlet opening which is open towards a combustion space of the combustion chamber;
a lance configured and arranged to introduce pilot fuel into the combustion space, which lance is arranged coaxially to the burner longitudinal center axis and extends from the burner head into the burner interior;
wherein the lance is configured and arranged so that at least when in a pilot mode of the burner the lance extends far enough into the burner interior for a flame front of a combustion reaction, which takes place in the combustion space, to extend at least partially into an end section of the burner interior which is enclosed by an outlet-side end region of the mixer; and
wherein the lance is positioned on the burner head and is longitudinally-adjustable so that, depending upon requirement, the lance can be retracted by a greater or lesser depth into the burner interior and can be extended from the burner interior by a greater or lesser distance.

2. The burner as claimed in claim 1, wherein the lance has an outlet-side end in a section of the burner interior which is enclosed by the mixer.

3. The burner as claimed in claim 2, wherein a distance of the lance end from the outlet opening is between 25% and 50% of the distance between an outlet-side end of the swirl generator and the outlet opening.

4. The burner as claimed in claim 1, further comprising:
an inlet pipe for liquid fuel which projects coaxially relative to the lance into the section of the burner interior which is enclosed by the swirl generator, the inlet pipe forming an annular inlet passage for liquid fuel and having at least one axial outlet opening, the inlet pipe being arranged on the burner head.

5. The burner as claimed in claim 4, wherein:
the inlet pipe is hollow-walled;
the inlet pipe encloses the lance, forming an axially open annular passage for air; and
the inlet passage is formed in the hollow wall of the inlet pipe.

6. The burner as claimed in claim 1, wherein:
the lance comprises a plurality of concentrically arranged pipes including a central inner pipe and a hollow-walled outer pipe;
wherein the central inner pipe includes a central passage for liquid fuel and has at least one axial outlet opening at the lance end;
wherein the hollow-walled outer pipe encloses the inner pipe, forming an inner annular passage for guiding air, and the hollow wall of the hollow-walled outer pipe includes at least one outer passage for gaseous fuel; and
wherein the inner annular passage terminates axially open at the lance end for guiding air.

7. The burner as claimed in claim 6, wherein the at least one outer passage in the hollow wall of the outer pipe comprises an annular passage which has:
at least one axial outlet opening at the lance end; or
a plurality of radial outlet openings in a lance end section which has the lance end; or
both.

8. The burner as claimed in claim 6, wherein:
the at least one outer passage comprises at least one passage which has at least one axial outlet opening at the lance end, at least one outer passage being formed in the hollow wall of the outer pipe; or
the at least one outer passage comprises at least one passage which has a plurality of radial outlet openings in a lance end section which includes the lance end, the at least one passage being formed in the hollow wall of the outer pipe; or
both.

9. The burner as claimed in claim 6, wherein the inner pipe projects axially beyond the outer pipe.

10. The burner as claimed in claim 1, further comprising:
a wall of the mixer comprising means for film cooling.

11. A method of operating a burner for a combustion chamber of a turbogroup, the method comprising:
providing a burner for a combustion chamber of a turbogroup, the burner comprising
a burner head,
a swirl generator enclosing a burner interior on an inlet side and which has at least one tangential air inlet relative to a longitudinal center axis of the burner,
a mixer enclosing the burner interior on an outlet side and which has an outlet opening which is open towards a combustion space of the combustion chamber,
a lance configured and arranged to introduce pilot fuel into the combustion space, which lance is arranged coaxially to the burner longitudinal center axis and extends from the burner head into the burner interior,
wherein the lance is configured and arranged so that at least when in a pilot mode of the burner the lance extends far enough into the burner interior for a flame front of a combustion reaction, which takes place in the combustion space, to extend at least partially into an end section of the burner interior which is enclosed by an outlet-side end region of the mixer; and operating the burner in a pilot mode for forming a combustion reaction, including combusting a fuel delivered through the lance, and longitudinally adjusting the position of the lance so that the lance tip extends far enough into the burner interior for a flame front of the combustion reaction in the combustion space to extend at least partially into an end section of the burner interior which is enclosed by an outlet-side end region of the mixer.

* * * * *